United States Patent [19]

Fukizawa et al.

[11] Patent Number: 4,838,961

[45] Date of Patent: Jun. 13, 1989

[54] METHOD OF MANUFACTURING HIGH STRENGTH BLANK A BOLT

[75] Inventors: Kazunori Fukizawa, Kiyose; Mitsushi Higuchi, Ichinomiya; Kunio Namiki, Nagoya, all of Japan

[73] Assignees: Nagoyo Screw Mfg. Co., Ltd.; Daido Tokushuko Kabushiki Kaisha, both of Aichi; Honda Giken Kogyo Kabushiki Kaisha, Tokyo, all of Japan

[21] Appl. No.: 179,501

[22] Filed: Apr. 8, 1988

Related U.S. Application Data

[62] Division of Ser. No. 802,608, Nov. 25, 1985, Pat. No. 4,778,652.

[30] Foreign Application Priority Data

Nov. 29, 1984 [JP] Japan ..... 59-250540

[51] Int. Cl.[4] ..... C21B 9/00

[52] U.S. Cl. ..... 148/12.4; 148/144

[58] Field of Search ..... 148/12.4, 143, 144

[56] References Cited

U.S. PATENT DOCUMENTS 4,319,934 3/1982 Henning ..... 148/12.4

4,584,032 4/1986 Isokawa et al. ..... 148/12 B

FOREIGN PATENT DOCUMENTS 56-69352 6/1981 Japan ..... 420/89

*Primary Examiner*—Deborah Yee

*Attorney, Agent, or Firm*—Browdy and Neimark

[57] ABSTRACT

A high strength bolt made of a steel having a specifically defined chemical composition, i.e., by weight C: 0.30–0.50%; Si: not more than 0.15%; Mn: not more than 0.40%; Cr: 0.30–1.50%; Mo: 0.10–0.70%; and V: 0.15–0.40%, the balance being Fe and inevitable impurities such as P, S, etc. in trace amount. The manufacturing method therefor is featured in a strictly controlled heat treatment in respect to the temperature range such as: hardening by quenching from 940°±10° C. and tempering 575°±25° C.

8 Claims, 2 Drawing Sheets

METHOD OF MANUFACTURING HIGH STRENGTH BLANK A BOLT

This is a division of application Ser. No. 802,608 filed Nov. 25, 1985, now U.S. Pat. No. 4,778,652.

BACKGROUND OF THE INVENTION

1. Field of the Art

The present invention relates to a high strength bolt and a method of manufacturing the same, and more particularly to a high strength bolt having a specific chemical composition and a manufacturing method therefor featured in heat treatment.

2. Related Art Statement

In recent years, remarkable tendency of lightening weight of automotive structural parts for the purpose of reducing fuel consumption naturally caused the necessity, also in the field of fastening bolts for fastening parts, to pursue high strength while demanding light weight.

When for example automotive parts or components become compact and of high strength, fastening bolts, such as connecting rod bolts and cylinder head bolts, for fastening those parts or components are necessarily required to be compact. It is quite natural that a small-sized bolt must be of high strength for maintaining its fastening capability.

Bolts of 12.9 class in the strength level, according to the ISO standard, have traditionally been utilized for such automotive-assembly use. Required strength standard conditions for such bolts of 12.9 class are:
tensile strength = 120–140 kgf/mm$^2$; and
0.2% proof stress $\geqq 0.9\times$ tensile strength.

Since the parts, which have been in harmony with bolts of just mentioned standard strength conditions, are now required to be more and more compact, bolts also have to catch up with the new demand for becoming smaller in size and greater in strength. This trend of the day demands appearance of higher strength bolts satisfying the conditions of ISO 14.9 class, that is to say:
tensile strength = 140–160 kgf/mm$^2$; and
0.2% proof stress $\geqq 0.9\times$ tensile strength.

Although there is stipulated, in JIS (Japanese Industrial Standard) as well as in ISO standard a high strenght bolt of 14.9 class in strength level, development of steel satisfying the necessary conditions for such a high strength bolt can not be said completed. That is to say, progress of the material for such a high strength bolt does not, as a matter of fact, satisfactorily follow the necessity of the present day.

Traditionally used bolt steel belongs to, as for its material quality, a Cr-Mo type steel such as JIS SCM440. It is well known that such a steel is remarkably deteriorated in the resistance to delayed fracture, when the tensile strength exceeds 120 kgf/mm$^2$. This resistance to delayed fracture is in fact a key condition required for the bolts in automotive use, which must be improved by all means today. Steel which has been improved to a somewhat required level in the tensile strength, can not be practically used in places where the tensile strength of 140–160 kgf/mm$^2$ level is actually applied, due to the deterioration of the resistance to delayed fracture.

An ideal steel, which is excellent in the resistance to delayed fracture and parallelly characterized in possessing features of high resistance to fatigue as well as high tensile strength, i.e., essential requirements to high strength bolts, has so far not been found.

SUMMARY OF THE INVENTION

The present invention was made in view of the above described situation in the art. It is accordingly an primary object of the present invention to provide high strength bolts, for pursuing the demand of the day, i.e., being compact and of high strength in compliance with the miniaturizing trend in parts, having unique chemical compositions for satisfying required standard conditions such as:
tensile strength within 140–160 kgf/mm$^2$; and
additionally, resistance to delayed fracture as well as fatigue.

It is another object of the invention to provide a novel method of manufacturing such high strength bolts, being featured in the heat treatment thereof.

It has traditionally been ascertained that the delayed fracture takes place, in the Cr-Mo type steel of high strength used for bolts, along the prior austenite grain boundaries.

The inventors made various strenuous studies and experiments for finding out the influence of the microstructure, the alloying elements, and the impurity elements to the occurring mechanism of the delayed fracture.

Essential points observed in the course of the study are summarized as follows (1)–(3):

(1) It is particularly preferable to choose a tempering temperature as high as possible. Since in the third stage of the tempering, wherein cementite precipitates, the cementite precipitated into the grain boundaries tends to embrittle the grain boundaries themselves, it is recommended to exclude this temperature range of cementite precipitation for obtaining steel of high tensile strength like 140–160 kgf/mm$^2$, i.e., it is preferable to choose a higher temperature for the tempering.

(2) Impurities such as P and S tend to segregate into austenite grain boundaries in the course of austenitization, so as to embrittle the grain boundaries, it is therefore advisable to hold down content of impurities to the lowest possible level.

(3) Since oxidation of the grain boundaries in the course of heat treatment such as hardening and tempering greatly degrades the strength of the grain boundaries, which deteriorates in turn the resistance to delayed fracture, it is preferable to reduce content of such elements as Mn, Si, etc. which are liable to oxidize the grain boundaries, to the minimum.

Among the above three findings, (3) is a unique and original discovery by the inventors, because there having been no such referring so far to the relation between the resistance to delayed fracture and the oxidation in the grain boundaries.

It is also another unique finding by the inventors that heat treatment conditions, above all the temperature range for the tempering, must be minutely controlled for parallelly satisfying both required conditions, that is, the tensile strength and the resistance to delayed fracture.

After having carefully studied and checked the chemical compositions and the heat treatment conditions necessitated for a special bolt steel of high strength, the inventors invented a bolt of high strength made of iron base alloy or steel with a specific chemical composition and a manufacturing method therefor including a specific heat treatment.

The gist of the present invention can be summarized into two sorts of high strength bolt made of steel consisting essentially of the composition of (I) and (II), and a manufacturing method for those two sorts of bolt.

The first chemical composition (I) of the invented high strength bolt consists essentially of:

0.30–0.50% by weight of C; not more than 0.15% by weight of Si; not more than 0.40% by weight of Mn; 0.30–1.50% by weight of Cr; 0.10–0.70% by weight of Mo; and 0.15–0.40% by weight of V, the balance being Fe and inevitable impurities such as P not exceeding 0.015% and S not exceeding 0.010%.

The second composition (II) thereof is permitted to additionally include one or more elements of the group consisting of 0.05–0.15% by weight of Nb; 0.05–0.15% by weight of Ti; and 0.05–0.15% by weight of Zr.

The method invention is specified, as to the manufacturing of the above defined high strength bolts of (I) and (II) composition, in the hardening by quenching the steel heated at a temperature of 940°±10° C. and the tempering thereafter at a temperature of 575°±25° C. In other words, the method according to the present invention comprises the steps of: (a) preparing a steel material of an iron base alloy consisting essentially of 0.30–0.50% by weight of carbon, not more than 0.15% by weight of silicon, not more than 0.40% by weight of manganese, 0.30–1.50% by weight of chromium, 0.10–0.70% by weight of molybdenum, and 0.15–0.40% by weight of vanadium, the balance being composed of iron and, as inevitable impurities, not more than 0.015% by weight of phosphorus and not more than 0.010% by weight of sulphur; (b) hardening by quenching said steel material heated at a temperature of 940°±10° C.; and (c) tempering said hardened material at a temperature of 575°±25° C.

The invention has thus succeeded in providing bolts of high strength which can not only fully satisfy the demands of the day requiring parallelly the high tensile strength of 140–160 kgf/mm$^2$ and the enhancement of 0.2% proof stress, but also possess excellent resistance to delayed fracture and fatigue. The invented bolts are of great effect, being likewise usable in the traditional strength level with equal or more performance, and further usable in a wider sphere, for example as bolts resistable in a high temperature place.

DETAILED DESCRIPTION OF THE INVENTION

Figure 1:
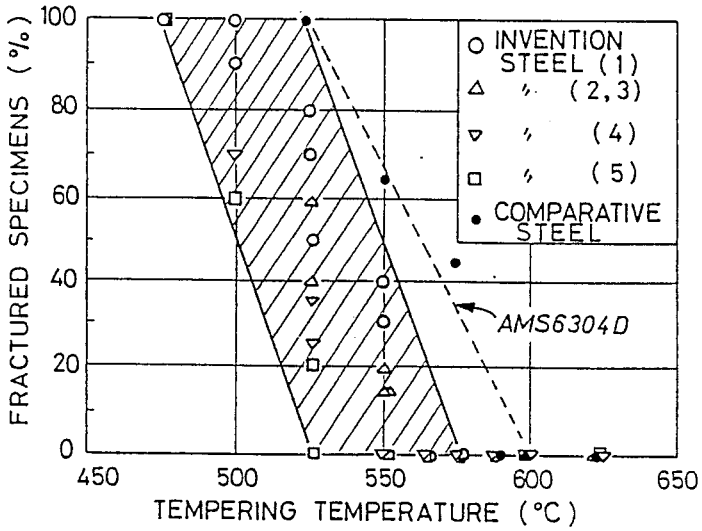
FIG. 1 is a graph showing results of delayed fracture test applied on test bolt specimens, by indicating the relation between the percentage (%) of fractured test pieces and the tempering temperature.

The present invention aims to improve the material steel for high strength bolts, considering the insufficiency of the traditional Cr-Mo type steel for answering the demand of the day to require higher and higher strength, by means of respectively limiting the content of elements to a specified ratio and minutely controlling the conditions of the heat treatment as follows.

Carbon (C) is an essential element for increasing the tensile strength, and the lower limit of its content for ensuring the tensile strength of 140–160 kgf/mm$^2$ is 0.30% by weight. When however the content thereof exceeds 0.50% by weight, it deteriorates not only toughness but also resistance to delayed fracture, obliging the upper limit to 0.50% by weight. For particularly enhancing the resistance to delayed fracture, in respect to relation with other elements, it is desired to keep the C content within the range of 0.40–0.50% by weight.

Silicon (Si) must be held down to as low content as possible, because it tends to promote internal oxidation and subsequently bring about the delayed fracture. Considering however its effect as a deoxidation element, only the upper limit of the content thereof is defined as 0.15% by weight. It is however preferable to keep its content below 0.10% by weight, for preventing deterioration in the resistance to delayed fracture by means of more effectively deterring the oxidation in the grain boundaries.

Manganese (Mn) is, like Si, preferable to be held down to the lowest possible content because of its inclination to promote undesirable oxidation of the grain boundaries. Considering however its role to make sure the tempering, the upper limit of the content alone being defined here as 0.40% by weight.

Phosphorus (P) must be reduced to the possible extreme limit so far as the refining technology permits, being consequently defined to 0.015% by weight or less, because it tends to embrittle the grain boundaries by segregating to the austenite grain boundaries in the course of austenization. It is more preferable to reduce it less than 0.010% by weight.

Sulphur (S) is, like P, preferable to be held down to the possible lowest limit so far as the refining technology permits, because of its inclination to deteriorate the resistance to delayed fracture due to its segregation to the grain boundaries and its coexistence with Mn as MnS. It is defined to less than 0.010% by weight, being preferable to be further confined to less than 0.005% by weight.

Chromium (Cr) is a necessary element for ensuring the resistance to softening of the invented steel. It is required to be contained, at the lowest, at the rate of 0.30% by weight so as to ensure a tempering temperature exceeding a certain temperature zone, wherein cementite is precipitated to the prior austenite grain boundaries, i.e., tempering temperature above approximately 500° C. in the present invention. Cr tends to lower, when its amount is increased, hardness of the steel in the temperature zone for high temperature tempering, consequently hindering to get a stable tensile strength not less than 140 kgf/mm$^2$. Its upper limit is fixed at 1.50% by weight, because of its liability to promote, like Si and Mn, the oxidation of the grain boundaries. It is however preferable to add it within a sphere of 0.90–1.10% by weight for stably obtaining a required tensile strength, preventing deterioration of the resistance to delayed fracture, and ensuring more effectively the hardenability and a temperature for the high temperature tempering.

Molybdenum (Mo) must be added, at the least, at 0.10% by weight for getting the tensile strength, at a tempering temperature not less than 500° C., within the scope of 140–160 kgf/mm$^2$ Adding Mo superabundantly exceeding 0.70% by weight is utterly useless because of saturation of the effect caused thereby. Another reason for limiting the highest content to 0.70% by weight is the expensiveness of the Mo element. It is however desirable to add Mo within the sphere of 0.45–0.65% by weight for ensuring a high tensile strength at a high temperature tempering.

Vanadium (V) is effective, forming a carbide, for refining austenite grains, and consequently contributes not only to enhancing the proof stress but also to improving the toughness. It is, similarly to Mo, helpful in increasing resistance to softening by its secondary hardening phenomenon, through being precipitated as a carbide in the course of a high temperature tempering process. It is required to add it for this purpose at a rate not less than 0.15% by weight, more preferably not less than 0.25% by weight. Superabundant addition thereof is also useless because of saturation of the effect. It is necessary on the contrary to fix the upper limit of its content not exceeding 0.40% by weight and preferably not exceeding 0.35% by weight, because too much addition is even harmful due to degradation of the toughness through formation of coarse carbide (primary carbide) during the process of ingot casting or billet formation.

Niobium (Nb), titanium (Ti), and zirconium (Zr) are respectively a useful element for making the crystal grains finer, indicating similar effect to V, and one or more of them may be optionally added, when necessary, because V is already added as the essential element. For each of them the content ratio is limited to within the sphere of 0.05–0.15% by weight. Addition thereof less than 0.05% by weight does not bring about the above-mentioned effect, and that exceeding 0.15% by weight uselessly saturates the effect because of the essentiality of V element addition.

In regard to the heat treatment conditions applied on steels having the earlier mentioned specific compositions, for simply satisfying the strength standard 14.9 in the ISO classification a considerably wide range of hardening temperature, i.e. temperature of steel to be quenched for hardening, like 900°–980° C., and of tempering temperature, i.e. temperature of heated steel for tempering, like 500°–650° C. is permissible. It has been discovered however in the experiments made by the inventors that application of the limited heat treatment conditions according to the invention on steels having compositions specified to the preferable range established by this invention remarkably improves the resistance to delayed fracture. Strict controlling of the hardening temperature within the range of 940°±10° C. and the tempering temperature within the range of 575°±25° C. is therefore essential for parallelly ensuring both the excellent tensile strength and resistance to delayed fracture.

EXAMPLE 1

Steels respectively having the composition indicated in Table 1 were rolled into bars of 8.0 mmϕ. Samples extracted from rolled bars were hardened from 940° C. and tempered at 575° C. Only the specimen L for comparison was hardened from 850° C. and tempered at 450° C. Each of the rolled bars was formed into M8 bolts, having been heat treated so as to have the tensile strength class of 140–160 kgf/mm$^2$. The quality of the formed bolts body and the material bar was respectively checked.

Figure 3:
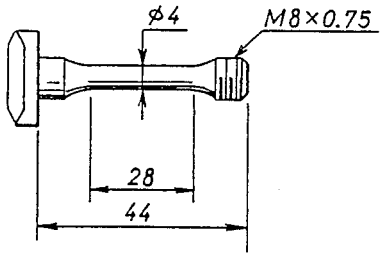
FIGS. 3 and 4 are respectively a diagrammatical view of a test piece for indicating the shape and the size (mm) thereof.

First of all, specimens or test pieces (FIG. 3) were made, according to JIS 14A standard, out of the formed M8 bolts for executing the tensile strength test. The results are indicated in Table 2, wherein all of the invention steels A-J fully satisfied the ISO strength standard 14.9, i.e., tensile strength and 0.2% proof stress. In each of the groups of the invention steels, D-F and I-J, wherein one or more out of the three elements Nb, Ti, and Zr was added to make the structure finer, an individual specimen showed a higher 0.2% proof stress in comparison with any specimen out of the groups A-C and G-H of the invention steels, wherein none of the three elements was added. On the other hand, comparative steels K (AMS 6304D) and L (JIS SCM440) had both the required tensile strength, while the comparative steel L did not reach the standard 0.2% proof stress.

On the bolt body the resistance to delayed fracture was executed. In particular, a bolt body, on which a stress was loaded by means of fastening it up as high as 0.2% proof stress, was thereafter immersed in a test solution of 0.1N HC( for as long as two hundred hours. Number of bolts fractured during the test was checked out of the twenty test bolts for figuring out the percentage thereof. The results were shown in FIG. 1, by means of plotting them on a graph, wherein the tempering temperatures were put on the abscissa as a criterion so as to fix each plotting position within the range of tensile strength 140–160 kgf/mm$^2$. As the comparative steel AMS 6304D was adapted to plot the result thereof on the same graph.

As can be seen in the test results of delayed fracture executed on bolt bodies, the temperature range in which none of the twenty bolt bodies were fractured was as wide as between 550° C. and 600° C. in case of the invented steels (4) and (5), while that in case of the comparative steel AMS 6304D was 600°–625° C., being somewhat narrow.

Figure 4:
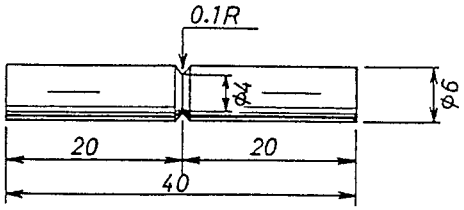
Figure 2:
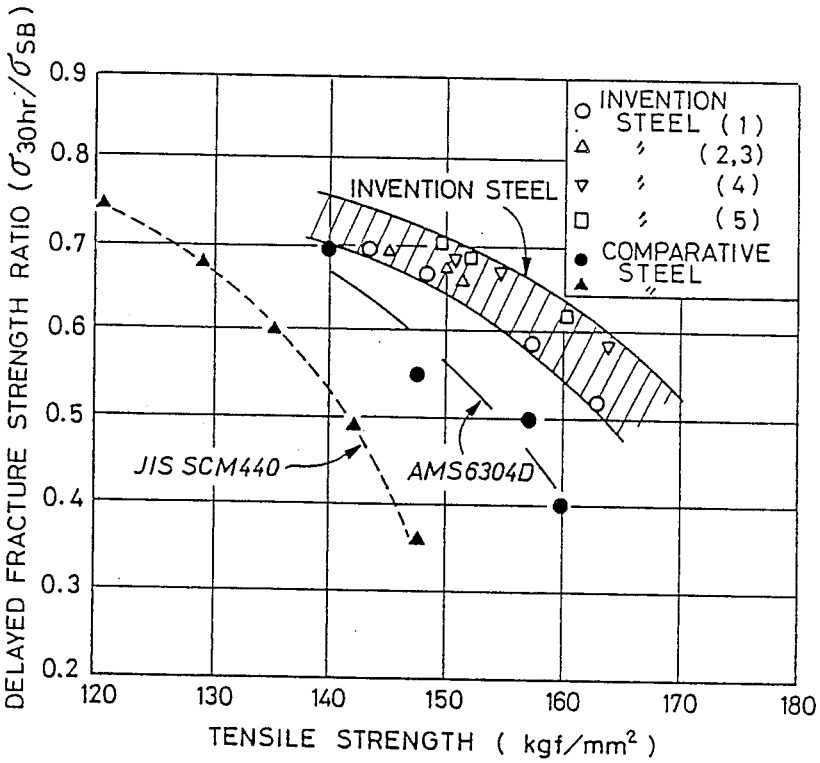
FIG. 2 is a graph showing the relation between the delayed fracture strength ratio and the tensile strength.

From the material bars of 8 mmϕ bending type test pieces illustrated in FIG. 4 were made for executing delayed fracture test (bending type accelerated test). The adapted test method was as undermentioned. The bending moment was applied by the dead weight sustained at the extended end of the test piece in a cantilever type testing device. The test solution of 0.1N HCl, was dropped on the notched part of the specimen. The delayed fracture curve was described as the ratio of bending moment vs time to fracture. Based on this curve the stress at 30 hr: $\sigma_{30}$hr (the stress at which fracture occurs after the holding time of 30 hours) and the static bending stress: $\sigma_{SB}$ (the stress at the zero time of the bending moment application) were determined, so as to define the ratio: $\sigma_{30}$hr/$\sigma_{SB}$ as the delayed fracture ratio. The resistance to delayed fracture was numerically evaluated based on this ratio. In FIG. 2 relation between the delayed fracture strength ratio and the tensile strength is indicated, by taking the former on the ordinate and the latter on the abscissa. On the graph, data of the comparative steels JIS SCM440, which is commonly used as equivalent to ISO 12.8 class, and AMS 6304D, which shows relatively high resistance to delayed fracture, are also indicated.

In FIG. 2, superiority of the invention steels to the comparative steels, in respect to the resistance to delayed fracture, can be evidently observed. Particularly the invention steels (4) and (5), wherein chemical components are limited within a preferable range of content, indicate remarkably high delayed fracture strength ratio. On the other hand, the comparative steel JIS SCM440 indicates, even in the range of low tensile strength of 120–140 kgf/mm$^2$, a gradual degradation of the delayed fracture strength ratio as the tensile strength rises upwards, while the invention steels indicate equal or higher ratio to the above-mentioned comparative steel even in such a high strength range.

TABLE 1

| Test steel | | Chemical composition of test steels (wt. %) C | Si | Mn | P | S | Cr | Mo | V | Nb | Ti | Zr |
|---|---|---|---|---|---|---|---|---|---|---|---|---|
| Invention steel (1) | A | 0.32 | 0.04 | 0.36 | 0.010 | 0.006 | 1.34 | 0.20 | 0.36 | — | — | — |
| | B | 0.41 | 0.07 | 0.15 | 0.013 | 0.008 | 0.55 | 0.63 | 0.23 | — | — | — |
| | C | 0.47 | 0.11 | 0.28 | 0.009 | 0.007 | 0.38 | 0.48 | 0.17 | — | — | — |
| Invention steel (2, 3) | D | 0.38 | 0.13 | 0.37 | 0.011 | 0.005 | 0.75 | 0.16 | 0.18 | 0.13 | — | — |
| | E | 0.42 | 0.08 | 0.24 | 0.010 | 0.006 | 0.47 | 0.43 | 0.30 | — | 0.11 | — |
| | F | 0.46 | 0.11 | 0.16 | 0.008 | 0.007 | 1.22 | 0.28 | 0.26 | 0.08 | — | 0.09 |
| Invention steel (4) | G | 0.48 | 0.05 | 0.30 | 0.004 | 0.003 | 0.93 | 0.58 | 0.33 | — | — | — |
| | H | 0.42 | 0.06 | 0.25 | 0.002 | 0.002 | 1.06 | 0.62 | 0.28 | — | — | — |
| Invention steel (5) | I | 0.46 | 0.04 | 0.22 | 0.007 | 0.004 | 1.05 | 0.41 | 0.32 | — | 0.06 | 0.08 |
| | J | 0.43 | 0.05 | 0.28 | 0.003 | 0.001 | 0.92 | 0.53 | 0.26 | 0.07 | 0.11 | — |
| Comparative steel AMS 6304D | K | 0.44 | 0.28 | 0.55 | 0.024 | 0.025 | 1.04 | 0.52 | 0.29 | — | — | — |
| Comparative steel JIS SCM440 | L | 0.40 | 0.26 | 0.74 | 0.018 | 0.027 | 0.99 | 0.21 | — | — | — | — |

TABLE 2

| Test steel | | Results of tensile strength test: Tensile strength (kgf/mm²) | 0.2% proof stress (kgf/mm²) | Elongation (%) | Reduction of area (%) |
|---|---|---|---|---|---|
| Invention steel (1) | A | 143 | 130 | 15 | 55 |
| | B | 148 | 135 | 14 | 50 |
| | C | 157 | 143 | 13 | 48 |
| Invention steel (2, 3) | D | 144 | 135 | 15 | 54 |
| | E | 150 | 140 | 13 | 49 |
| | F | 151 | 141 | 13 | 48 |
| Invention steel (4) | G | 155 | 141 | 13 | 48 |
| | H | 151 | 140 | 13 | 50 |
| Invention steel (5) | I | 150 | 142 | 13 | 52 |
| | J | 152 | 143 | 14 | 53 |
| Comparative steel AMS 6304D | K | 147 | 138 | 13 | 50 |
| Comparative steel JIS SCM440 | L | 150 | 121 | 11 | 52 |

EXAMPLE 2

For studying and checking the influence of the heat treatment conditions, particularly that of the tempering temperature, to the resistance to delayed fracture, bolts were made under the same conditions as in the Example 1, however with the variable hardening temperature. In this experiment tensile strength test was executed along with a checking of the delayed fracture strength ratio performed partially with regard to the material steel. The results are indicated in Table 3. What has been found from this experiment is that a slight deviation of the hardening temperature from the predetermined range 940°±10° C., upwardly or downwardly, does not affect the maintenance of the tensile strength at not lower than 140 kgf/mm² level, but deteriorates the resistance to delayed fracture.

TABLE 3

| Test steel | Classification | Heat treatment conditions and strength: Hardening temperature (°C.) | Tempering temperature (°C.) | Tensile strength (kgf/mm²) | Delayed fracture strength ratio* |
|---|---|---|---|---|---|
| G | The invention | 940 | 575 | 151 | 0.68 |

TABLE 3-continued

| Test steel | Classification | Heat treatment conditions and strength: Hardening temperature (°C.) | Tempering temperature (°C.) | Tensile strength (kgf/mm²) | Delayed fracture strength ratio* |
|---|---|---|---|---|---|
| | Comparative example | 935 | 500 | 156 | 0.55 |
| I | The invention | 940 | 600 | 149 | 0.71 |
| | Comparative example | 960 | 575 | 150 | 0.60 |

EXAMPLE 3

Bolts must be, for being utilized as high strength bolts, high not only in the resistance to delayed fracture but also in the resistance to fatigue. As a means for enhancing resistance or strength against fatigue, it seems to be recommendable to divide the roll threading process into two steps, i.e., one half prior to the heat treatment and another half after the heat treatment, so as to raise the compressive residual stress after the heat treatment. It is appropriate, in this regard of division, to do the roll threading from 50 to 95% prior to the heat treatment, so as to leave from 50 to 5% thereof after the heat treatment.

For the purpose of ascertaining this theory, roll threading test was executed on a bolt body of the invention steel H, which was obtained in Example 1, under the conditions of roll threading indicated in Table 4. The test was concerned to fatigue of the bolt, conditions and results thereof being indicated in the Table 4. What was found from the experiment is that the strength against fatigue can be raised, in the bolts of the invention steel, without deteriorating the resistance to delayed fracture, which is originally the strong point of the invention steel. Further raising of the strength against fatigue can be expected in the division of the roll threading before and after the heat treatment.

It was ascertained in another experiment that raising of the compressive stress, in ordinary steel for bolts, i.e., raising of the strength is liable to deteriorate or sacrifice the resistance to delayed

TABLE 4

| Test steel | Tensile strength | Alternating fatigue test: Roll threading | Alternating fatigue test: Fatigue strength at $2 \times 10^6$ cycles |
|---|---|---|---|
| H | 153 kgf/mm$^2$ | Before heat treatment 80% | 11 kgf/mm$^2$ |
| | | After heat treatment 20% | |
| | | Before heat treatment 100% | 9 kgf/mm$^2$ |

Test condition: Average stress 81 kgf/mm$^2$

The steel according to this invention was developed aiming at the use in a class of strength 140–160 kgf/mm$^2$, but it can of course be used, as is evidently cleared in the Examples, at a lower strength with the expectation of equal or higher performance than the conventional steel. Furthermore, the invented high strength bolt can be used not only undernormal room temperature, but also under high temperature.

It must be understood that various slight alterations and variations can be thought of by those skilled in the art, and that this invention is not limited to the disclosed examples and what was described herein, but include all of those modifications so far as they do not deviate from the spirit and scope of this invention stated herein and appended claims.

What is claimed is:

1. A method of manufacturing a high strength blank for a bolt, comprising the steps of:

preparing a steel material of an iron base alloy consisting essentially of 0.30–0.50% by weight of carbon, not more than 0.15% by weight of silicon, not more than 0.40% by weight of manganese, 0.30–1.50% by weight of chromium, 0.10–0.70% by weight of molybdenum, and 0.15–0.40% by weight of vanadium, the balance being composed of iron and, as inevitable impurities, not more than 0.015% by weight of phosphorus and not more than 0.010% by weight of sulphur;

hardening by quenching said steel material heated at a temperature of 940°±10° C.; and tempering said hardened material at a temperature of 575°±25° C.

2. A method of manufacturing a high strength blank for a bolt as recited in claim 1, wherein the content of said chromium is in the range of 0.90–1.10% by weight.

3. A method of manufacturing a high strength blank for a bolt as recited in claim 1, wherein the content of said molybdenum is in the range of 0.45–0.65% by weight.

4. A method of manufacturing a high strength blank for a bolt as recited in claim 1, wherein the content of said vanadium is in the range of 0.25–0.35% by weight.

5. A method of manufacturing a high strength blank for a bolt, comprising the steps of:

preparing a steel material of an iron base alloy consisting essentially of 0.30–0.50% by weight of carbon, not more than 0.15% by weight of silicon, not more than 0.40% by weight of manganese, 0.30–1.50% by weight of chromium, 0.10–0.70% by weight of molybdenum, and 0.15–0.40% by weight of vanadium, and one or more elements selected from the group consisting of 0.05–0.15% by weight of niobium, 0.05–0.15% by weight of titanium, and 0.05–0.15% by weight of zirconium, the balance being composed of iron and, as inevitable impurities, not more than 0.015% by weight of phosphorus and not more than 0.010% by weight of sulphur;

hardening by quenching said steel material heated at a temperature of 940°±10° C.; and tempering said hardened material at a temperature of 575°±25° C.

6. A method of manufacturing a high strength blank for a bolt as recited in claim 5, wherein the content of said chromium is in the range of 0.90–1.10% by weight.

7. A method of manufacturing a high strength blank for a bolt as recited in claim 5, wherein the content of said molybdenum is in the range of 0.45–0.65% by weight.

8. A method of manufacturing a high strength blank for a bolt as recited in claim 5, wherein the content of said vanadium is in the range of 0.25–0.35% by weight.

* * * * *